US007836547B2

(12) United States Patent
Cordes et al.

(10) Patent No.: US 7,836,547 B2
(45) Date of Patent: Nov. 23, 2010

(54) VACUUM CLEANER WITH HAND GRIP AND ADAPTER

(75) Inventors: Martin Cordes, Sundern (DE); Stephan Cordes, Arnsberg (DE)

(73) Assignee: Fischer Rohrtechnik GmbH, Achern-Fautenbach (DE)

( * ) Notice: Subject to any disclaimer, the term of this patent is extended or adjusted under 35 U.S.C. 154(b) by 753 days.

(21) Appl. No.: 11/848,327

(22) Filed: Aug. 31, 2007

(65) Prior Publication Data

US 2008/0052871 A1 Mar. 6, 2008

(30) Foreign Application Priority Data

Aug. 31, 2006 (DE) ..... 10 2006 040 948

(51) Int. Cl.
*A47L 9/24* (2006.01)

(52) U.S. Cl. ..... 15/410; 15/314; 285/7; 439/191; 439/192

(58) Field of Classification Search ..... 15/314, 15/410; 285/7; 439/191, 192; *A47L 9/24, A47L 9/32*

See application file for complete search history.

(56) References Cited

U.S. PATENT DOCUMENTS 4,969,837 A * 11/1990 Genoa et al. ..... 439/191
5,472,346 A 12/1995 Gray et al.
5,551,731 A 9/1996 Gray et al.
6,015,298 A 1/2000 Linhart
7,765,641 B2 * 8/2010 Cunningham ..... 15/410
2006/0174440 A1 8/2006 Genoa et al.

FOREIGN PATENT DOCUMENTS

| | | |
|---|---|---|
| DE | 2 142 068 | 3/1973 |
| DE | 10 2004 004 009 A1 | 8/2005 |
| EP | 0 528 101 A1 | 2/1993 |
| EP | 0 733 336 A2 | 9/1996 |
| EP | 1 028 282 A2 | 8/2000 |
| FR | 2 772 107 A1 | 6/1999 |

* cited by examiner

*Primary Examiner*—David A Redding
(74) *Attorney, Agent, or Firm*—Roberts Mlotkowski Safran & Cole, P.C.; David S. Safran

(57) ABSTRACT

A vacuum cleaner with a handle and an adapter accommodates the end region of the vacuum cleaner suction pipe at one end and the pipe socket of the handle at the other end is improved by the adapter being of a durable construction that does not require a new vacuum cleaner suction pipe when the adapter is broken is achieved by the adapter being formed of at least two shells which are pivotably connected together via a film hinge which runs parallel to the lengthwise axis of the vacuum cleaner suction pipe and by their free end regions having a screw connection by which the adapter is detachably braced against the facing end region of the vacuum cleaner suction pipe in the mounted position of the adapter.

13 Claims, 8 Drawing Sheets

V
38
39

XVI
XIV

VACUUM CLEANER WITH HAND GRIP AND ADAPTER

BACKGROUND OF THE INVENTION

1. Field of the Invention

The invention relates to a vacuum cleaner with a handle and adapter which accommodates the end region of the vacuum cleaner suction pipe on one end and the pipe socket of the handle on its other end, and is coupled to the pipe via a detachable locking means, via electrical couplings there being an electrically conductive connection from the nozzle on the free end of the vacuum cleaner suction pipe, via the vacuum cleaner suction pipe, the adapter, the handle, and the flexible vacuum hose to the power supply of the vacuum cleaner.

2. Description of Related Art

This type of vacuum cleaner has been used in the United States for a long time and is in use. In the vacuum cleaner according to the prior art, the adapter is formed of a plastic strip which extends positively under the lower part of the end region of the vacuum cleaner suction pipe and which projects with an extension which is U-shaped in cross section over the end of the vacuum cleaner suction pipe, and is provided with a plug for coupling to the socket part on the handle in the crosspiece region of the U-shaped cross section. The plug is connected to a coiled electrical line which extends along the vacuum cleaner suction pipe. The adapter is attached permanently with several rivets to the end region of the vacuum cleaner suction pipe. If this adapter is exposed to bending or impact forces, for example, when placed abruptly on the floor or when the vacuum cleaner suction pipe is improperly coupled or supported, the adapter can break off, with the result that, then, not only the adapter, but the complete vacuum cleaner suction pipe must be replaced by a new one.

Furthermore, European Patent Application EP 0 733 336 A2 and corresponding U.S. Pat. Nos. 5,551,731 and 5,472,346 disclose a different type of vacuum cleaner in which the adapter is connected integrally to the handle, and at the same time, forms both part of the handle and also part of the vacuum cleaner suction pipe which is connected to it and which is divided into several component vacuum cleaner suction pipes via locking means and is interconnected via several locking means. In the case of breakage of the adapter on the handle, the entire handle with the pipe socket and the hose located on it must be replaced.

SUMMARY OF THE INVENTION

A primary object of the present invention is to devise a vacuum cleaner of the initially mentioned type which has not only a durable adapter, but also does not require a new vacuum cleaner suction pipe when the adapter is broken.

This object is achieved in accordance with the invention in conjunction with the initially named generic concept in that the adapter is formed by at least two shells which are connected to be able to pivot via a film hinge which runs parallel to the lengthwise axis of the vacuum cleaner suction pipe, and via a screw connection on their free end regions are detachably braced against the facing end region of the vacuum cleaner suction pipe in their end mounting position. With this vacuum cleaner, for the first time, an adapter which can be detached from the vacuum cleaner suction pipe is devised which can be quickly replaced by a new one in case of damage.

Moreover, with its one end it completely surrounds the region of the vacuum cleaner suction pipe facing it, and not as in the prior art, only on a small peripheral region, and is braced in final mounting without wobbling relative to this end region of the vacuum cleaner suction pipe via a screw connection, and thus, is connected positively and nonpositively to the vacuum cleaner suction pipe. By its complete and thus protective twisting of the end region of the vacuum cleaner suction pipe, the entire vacuum cleaner acquires not only a durable, but also an optically pleasing shape.

To stop torsion of the vacuum cleaner suction pipe relative to the handle, the adapter, besides it bracing against the end of the vacuum cleaner suction pipe, is provided with an anti-torsion means. This anti-torsion means advantageously is formed of a recess on the end of the vacuum cleaner suction pipe facing the adapter and of an adapter cam which engages it.

Pulling the adapter off the end region of the vacuum cleaner suction pipe is stopped both by this cam and also by the nonpositive bracing, and pulling the adapter off the pipe socket of the handle is stopped by the locking means.

According to one especially advantageous development of the invention, the adapter is formed altogether of three shells which are connected to one another via two film hinges which run parallel to the lengthwise axis of the vacuum cleaner suction pipe. Of them, the two outer shells are roughly the same and the middle shell is made in the form of a strip. The inner side of all of the shells has the shape of pitch circle segments which in their end mounting position circularly surround the end region of the vacuum cleaner suction pipe held by them and the pipe socket of the handle. In this way, this end region of the vacuum cleaner suction pipe is also protected by the adapter against deformation.

Furthermore, the adapter, by circularly surrounding the end region, adapts both to the shape of the vacuum cleaner suction pipe and also that of the handle with the result that not only a durable, detachable coupling, but also an optically pleasing connection between the handle and the vacuum cleaner suction pipe are formed.

Advantageously, in the three-part shell shape of the adapter, the two outer shells on their end facing the handle are each provided with a projecting strip which is L-shaped in cross section and which in their end mounting position form a receiver which is U-shaped in cross section for the part of the handle which is likewise U-shaped in cross section and which is made geometrically similar on its bottom and extend under it. In this connection, the U-shaped receiver is used not only to facilitate coupling between the adapter and pipe socket by the locking means, but also for exact guidance, free of torsion, from the plug part into the socket part of an electrically conductive connection which will be detailed below.

The middle part of the shell is advantageously provided in its middle region with a button molded in the shape of a leaf spring for pressing down the locking means on the pipe socket. In the prior art, this button has been located opposite the adapter on the outer periphery of the vacuum cleaner suction pipe, and thus, it required additional attachment. In this way, the vacuum cleaner suction pipe remains smooth without a rivet connection and matches the overall impression in terms of streamlining and in an optically favorable manner.

To achieve high stiffness and impact strength, in spite of saving material in the configuration of the wall thicknesses, the shells are provided with stiffening ribs on their insides. These stiffening ribs are made in the shape of a pitch circle on their free ends in order to be able, accordingly, to favorably adapt elastically to the outside diameter of the end region of the vacuum cleaner suction pipe by bracing.

Advantageously, on each of the two end regions of a shell, there is a through opening for a clamping screw and on the inside of the opposite shell there are blind holes corresponding thereto for holding the clamping screws. For a three-part shell, the through openings for the clamping screws and the receivers of the clamping screws are made on the outside shells, but not on the middle shell.

For a generic vacuum cleaner which is provided with a brush or a roller on its nozzle part, its electric drive requires an electrical connecting line for current supply. This connecting line is routed from the nozzle via the vacuum cleaner suction pipe, the handle on which generally there is the corresponding electric switch and via the following flexible hose to the power supply of the motor for driving the intake radial fan. To form this electrical connection, the shells on their end region facing the handle have a recess for insertion of an electric plug for this electrically conductive connection along the vacuum cleaner suction pipe. This plug is coupled to an electrical socket part located on the face end of the handle when the adapter is slipped over the pipe socket of the handle. This electrically conducting line is then routed through the handle and the subsequent vacuum hose to the above described power supply.

For simple and economical production, shells are produced from plastic, especially from polyamide (PA) or polypropylene (PP). The vacuum cleaner suction pipe can be made in the conventional manner as a telescoping pipe.

One embodiment of the invention is shown the drawings and described in detail below.

DETAILED DESCRIPTION OF THE INVENTION

Figure 1:
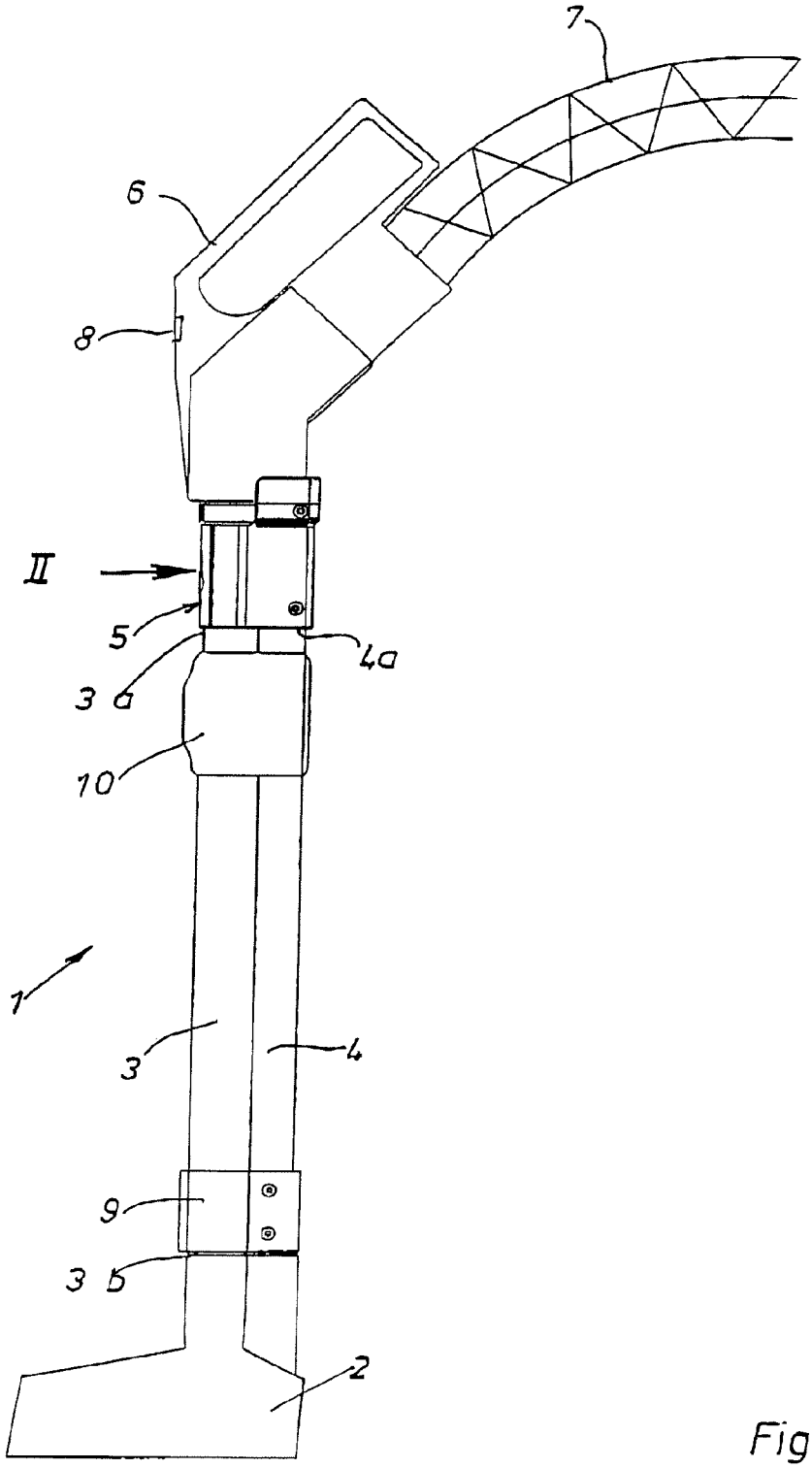
FIG. 1 is a partial view of a vacuum cleaner with the nozzle part, vacuum cleaner suction pipe, adapter, handle and flexible hose.

As shown in FIG. 1, the vacuum cleaner 1 comprises a nozzle 2, a vacuum cleaner suction pipe 3, a cable channel 4, an adapter 5, a handle 6 and a flexible hose 7. For example, in order to be able to actuate a brush which is present on the nozzle 2 and which is driven by an electric motor, an electrically conductive connection from the nozzle 2 via the cable channel 4 of the vacuum cleaner suction pipe 3, the adapter 5, the handle 6 and via a flexible hose 7 to the power supply of an intake radial fan (not shown) must be ensured. This electrically conductive connection can be turned on and off via a switch 8 which is attached to the handle 6. The cable channel 4 is held on the vacuum cleaner suction pipe 3 by a clamp 9 and a slider 10 and by one end of the adapter 5.

Figures 4, 5, 5A:
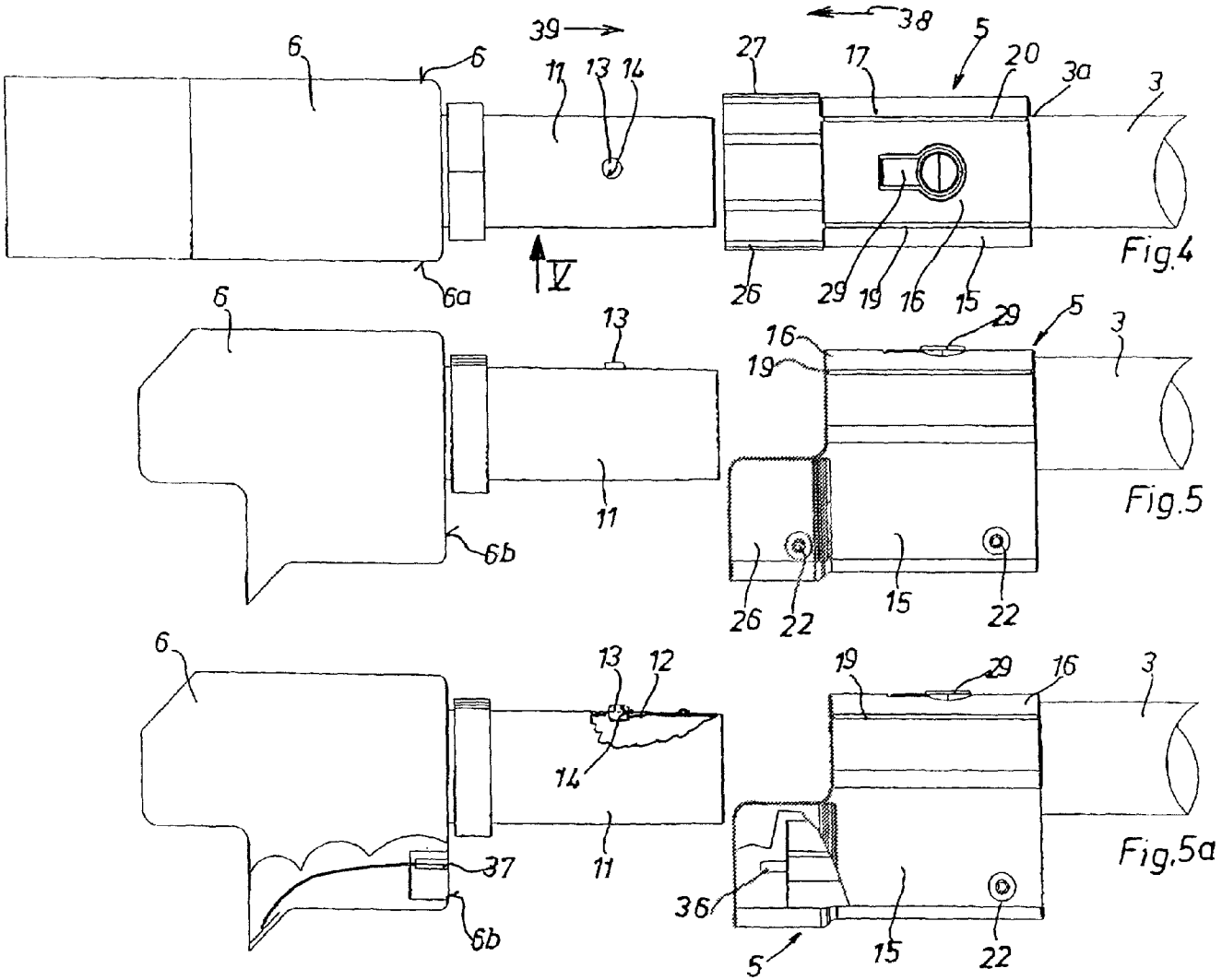
FIG. 4 is a view similar to that of FIG. 2 in the position of the adapter with the vacuum cleaner suction pipe decoupled from the pipe socket of the handle.
FIG. 5 shows a view in the direction of the arrow V in FIG. 4.
FIG. 5*a* is a view corresponding to that of FIG. 5 partially broken away to show the inserted plug part in the adapter and the inserted socket part in the handle.
Figure 17:
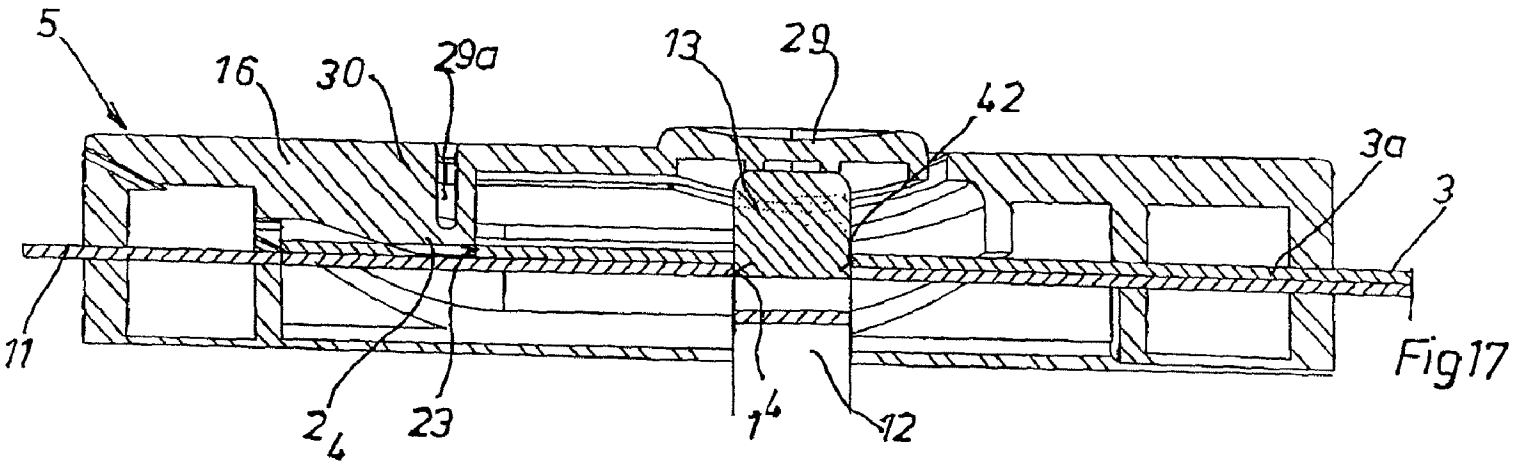
FIG. 17 shows an enlarged extract of dot-dash encircled area XVII of FIG. 6.
Figure 18:
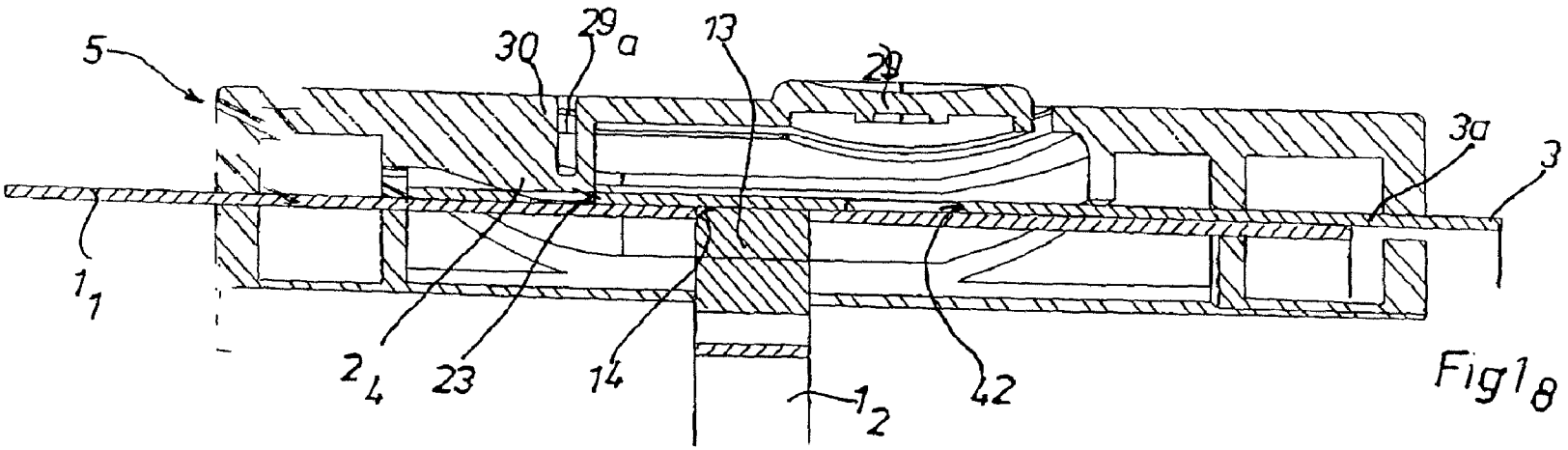
FIG. 18 shows an enlarged extract of dot-dash encircled area XVIII from FIG. 7.

In order to be able to detach the vacuum cleaner suction pipe 3 with its adapter 5 from the handle 6 after use, in the prior art, the locking pin 13 (FIGS. 4, 5, & 5*a*) had to be pushed down for unlocking by a button 29 attached to the end region of the vacuum cleaner suction pipe 3. In this unlocking process, for example, if bending forces are applied to the adapter, it can break. As shown in FIGS. 4 & 5, in the invention, the locking means is formed of a leaf, bow or annular spring 12 which is located on the pipe socket 11 of the handle 6, with a catch projection 13 which extends through an opening 14 of the pipe socket 11 and then through an opening 42 in the end region 3*a* of the vacuum cleaner suction pipe 3 (see, FIGS. 17 & 18).

Figure 3:
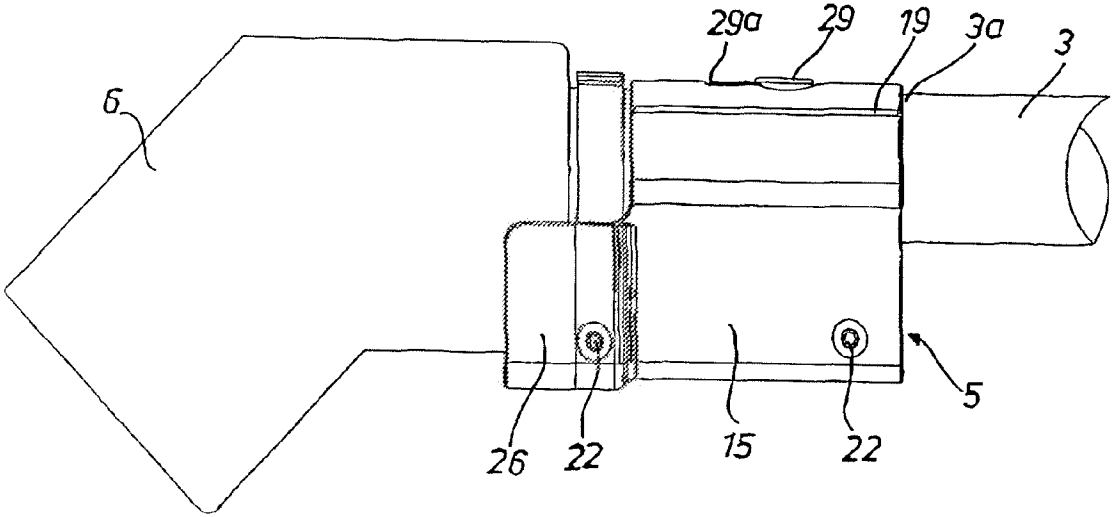
FIG. 3 is a view in the direction of arrow III from FIG. 2.

In order not to have to replace the entire vacuum cleaner suction pipe 3 when the adapter breaks in this way, the adapter 5 is formed in accordance with the invention by three shells 15, 16, 17 (FIGS. 8 & 9) which are connected to be able to pivot via two film hinges 19, 20 which run parallel to the lengthwise axis 18 of the vacuum cleaner suction pipe 3 and on their free end regions 21 are detachably braced against the facing pipe end 3*a* of the vacuum cleaner suction pipe 3 via a respective screw connection 22 in their end mounting region (see, FIGS. 3 & 5). The other end 3*b* of the vacuum cleaner suction pipe 3 is detachably coupled to the nozzle 2 via a catch connection (see, FIG. 1).

The adapter 5 is provided with an anti-torsion means besides with its bracing against the end region 3*a* of the vacuum cleaner suction pipe 3. This anti-torsion means according to FIGS. 7, 8, 17 and 18 consists of a recess 23 on the end region 3*a* of the vacuum cleaner suction pipe 3 facing the adapter 5 and of a cam 24 on the adapter 5 which engages in recess 23, thereby preventing relative rotation between the adapter 5 and the suction pipe 3.

Figure 6:
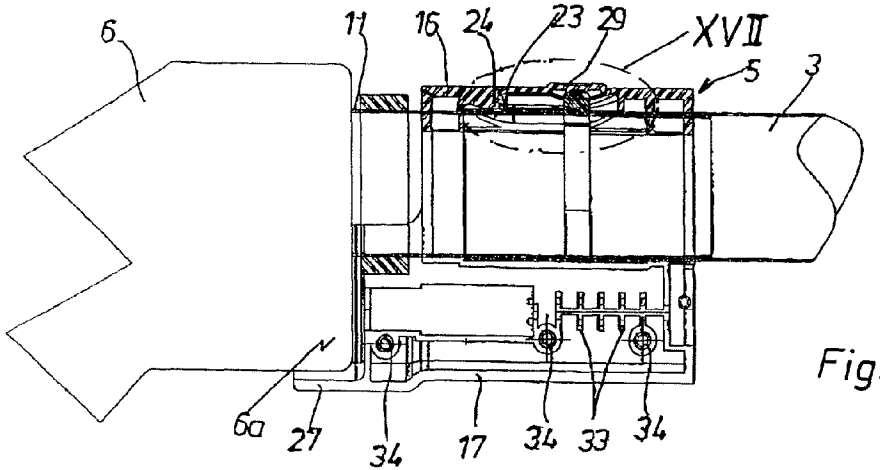
FIG. 6 is a sectional view taken along line VI-VI in FIG. 2.
Figure 7:
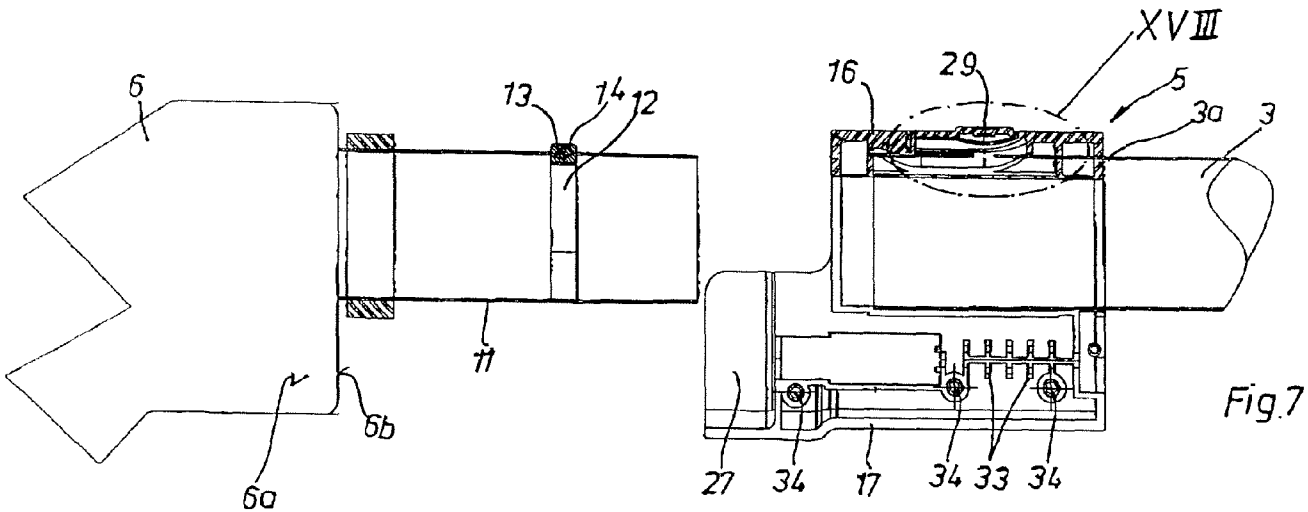
FIG. 7 is a sectional view corresponding to that of FIG. 6 but showing the adapter decoupled from the pipe socket of the handle.

As follows from FIGS. 6, 7 and 10, on the adapter 5, there is another screw connection 25 which is use if—for whatever reasons—one of the two screw connections 22 should become unusable. In this case, then, the adapter 5 can be secured against the end region 3*a* of the vacuum cleaner suction pipe 3 via the other additional screw connection 25.

Figure 8:
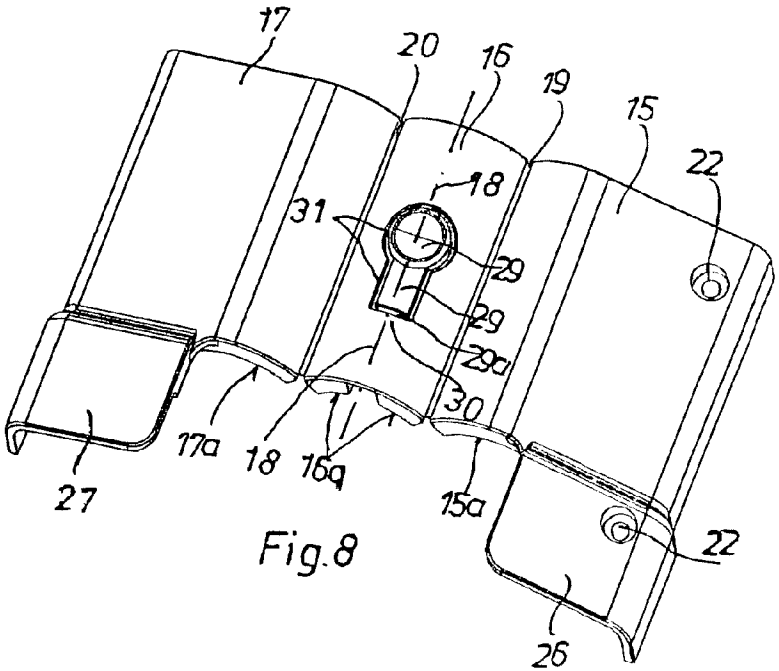
FIG. 8 is a perspective top view of the adapter with the three shells unfolded.
Figure 12:
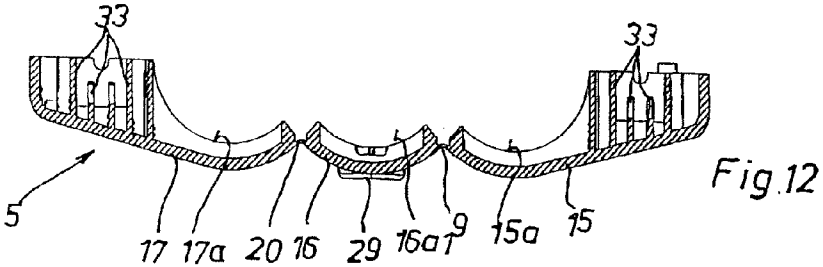
FIG. 12 is a sectional view taken along line XII/XII in FIG. 10.
Figures 13, 14, 15, 16:
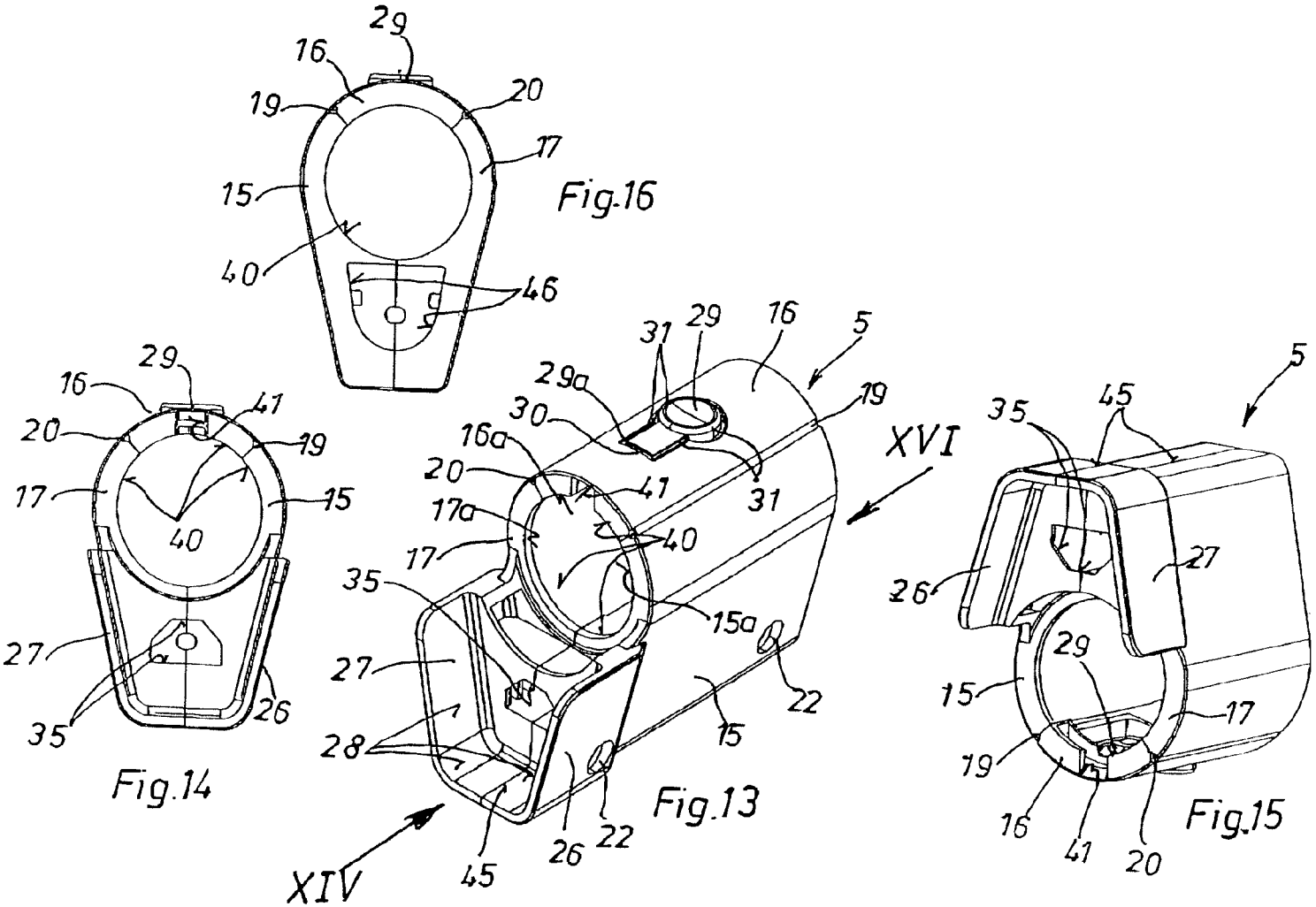
FIG. 13 is a perspective view of the adapter part in its closed position.
FIG. 14 is a front view in the direction of the arrow XIV in FIG. 13.
FIG. 15 is a perspective view in the direction of the arrow XIV in FIG. 13 but turned by 180° about its longitudinal axis.
FIG. 16 is a view of the adapter in the direction of the arrow XVI in FIG. 13.

The shells 15, 16, 17 as shown in FIGS. 8, 12, & 13, on their inner sides 32 are provided with pitch circle segments 15*a*, 16*a*, 17*a* which, with the adapter 5 in its closed position (see, FIGS. 13 to 16) mounted on the suction pipe 3 (see, FIGS. 2 & 3), circularly surround and hold the end region 3*a* of the vacuum cleaner suction pipe 3, and the pipe socket 11 of the handle 6.

Furthermore, on the end 21 of the two outer shells 15, 17 facing the handle 6 are each shell is provided with a projecting strip 26, 27 which is L-shaped in cross section, and which, in the assembly position of the adapter 5 (see especially FIG. 13 in conjunction with FIG. 2) form a receiver 28 which is U-shaped in cross section (see, FIGS. 13 & 14) for the part 6*a* of the handle 6 which is likewise U-shaped in cross section and which is made geometrically similar and extend under the handle. As is most apparent from FIGS. 8 & 9 in conjunction with FIGS. 2 & 4, the middle part 16 of the shells 15 to 17 is provided with a button 29 in its center region that is molded on in the manner of a leaf spring for pressing down the projection 13 of the locking means 12, 13, 14 on the pipe socket 11. This leaf spring-like button 29, at its end 29*a*, is molded onto the region 30 of the middle shell 16 which directly borders it and which acts as an elastic hinge. Otherwise the leaf spring-like button 29 is surrounded by a peripheral annular gap 31 for its free pivoting mobility.

Figure 11:
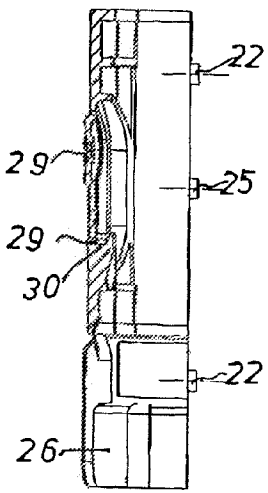
FIG. 11 is a sectional view taken along line XI-XI in FIG. 10.

The shells 15, 16, 17 are provided with stiffening ribs 33 on their inner sides 32 (FIGS. 10 to 12) in order to impart to the adapter 5, in spite of its relatively thin walls, a flexurally stiff and impact-resistant configuration.

Figure 2:
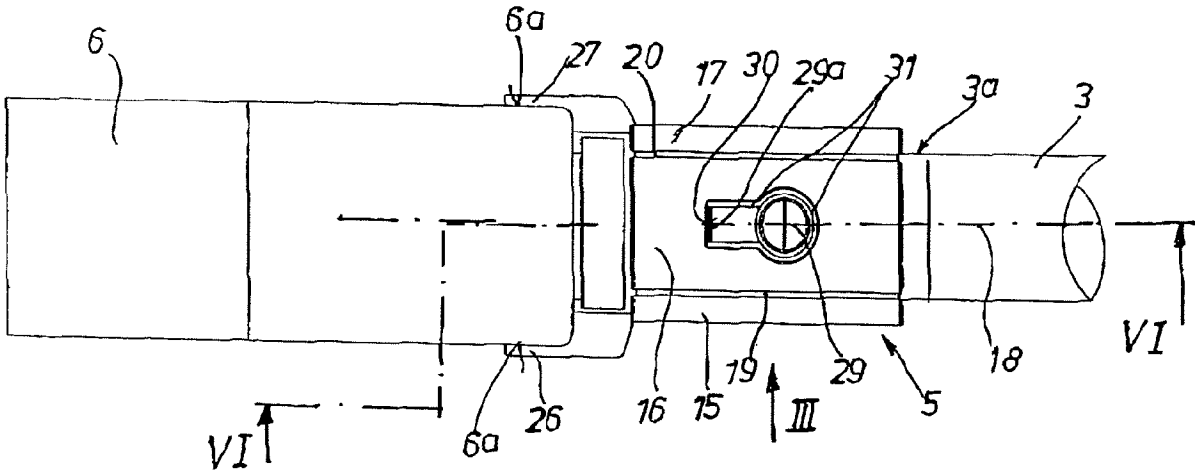
FIG. 2 is a partial view of the adapter and handle in the direction of the arrow II from FIG. 1.
Figure 9:
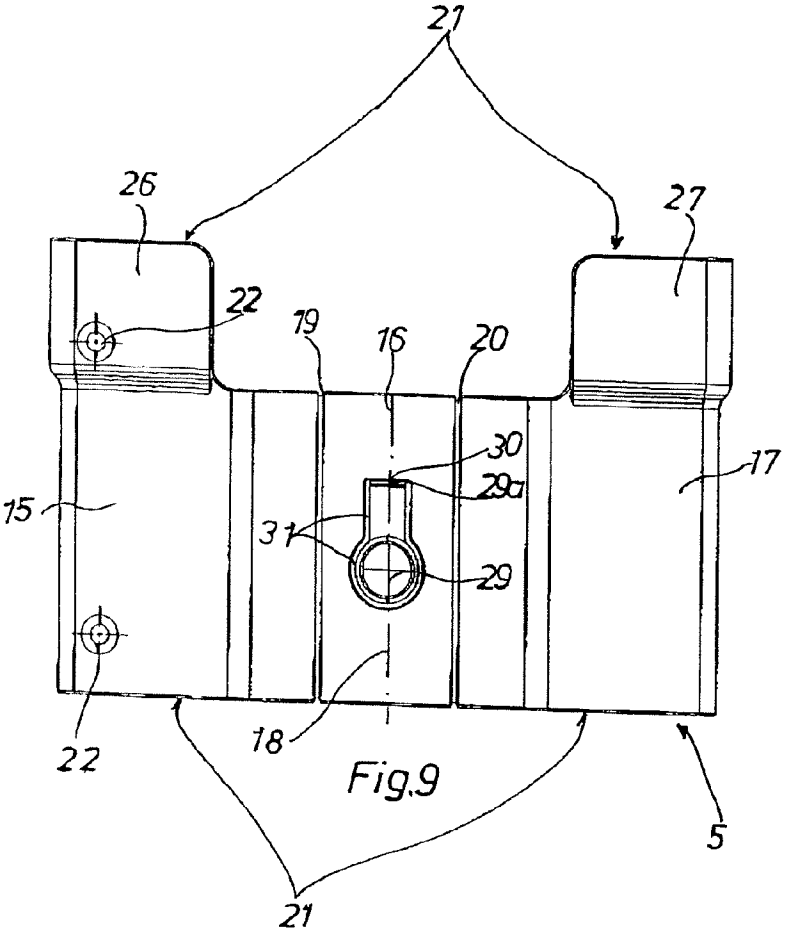
FIG. 9 is a top view of the adapter with the three shells unfolded.
Figure 10:
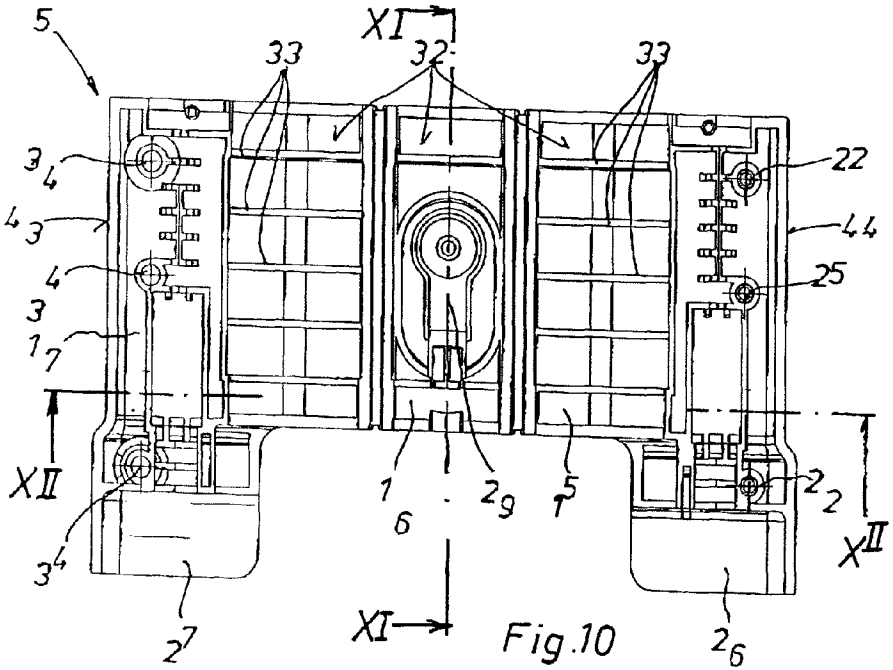
FIG. 10 is a bottom view of the adapter with the three shells unfolded.

As shown in FIGS. 9 & 10, on the two end regions 21 of one shell—here the outer shell 15—there is are through openings 22 for the clamping screws and on the inside 32 of the other outer side shell—shell 17—there are corresponding blind holes 34 for holding the clamping screws. Moreover, the shells 15, 17 on their end region 21 facing the handle 6 have a recess 35 (see, FIGS. 13 & 14) for insertion of an electrical plug 36 (FIG. 5*a*) which is coupled in the position of use to an electrical socket part 37 which is located on the facing end 6*b* of the handle 6 as shown in FIGS. 2 & 3.

This position of use is reached by either the adapter 5 with the vacuum cleaner suction pipe 3 being pushed in the direction of the arrow 38 and/or the pipe socket 11 of the handle 6 being pushed in the direction of the arrow 39 as shown in FIGS. 4 & 5. In this motion, the pipe socket 11 slides into the round opening 40 (FIG. 13) of the adapter 5. In this connection, the catch pin 13 which is under the action of the leaf, bow or ring spring 12 is inserted into a guide recess 41 of the middle shell 16 (see, FIGS. 13 & 14). This guide recess 41 has a rising sliding surface, by which the catch pin 13 is pressed into the opening 14 against the action of the spring 12, until it locks in the opening 42 in the end region 3*a* of the vacuum cleaner suction pipe 3 (FIGS. 6 & 7). By pressing down the button 29 on the adapter 5 while simultaneously pulling the handle 6 and vacuum cleaner suction pipe 3 apart, the adapter 5 can be detached again from the handle 6.

The end edges 43, 44 (FIG. 10) of the shells 17, 15 abut one another in their end mounting location so as to form a tight parting joint 45, as can be seen especially from FIGS. 13 & 15, after securing of the shells 15, 16, 17 against the end region 3*a* of the vacuum cleaner suction pipe 3. In this connection, it goes without saying that this abutting of the end edges 43, 44 takes place only after complete bracing of the pitch circle segments 15*a*, 16*a*, 17*a* of the shells 15, 16, 17 against the end region 3*a* of the vacuum cleaner suction pipe 3.

Moreover, the two outer shells 15, 17 on their back end, as shown in FIG. 16, have a recess 46 in which the end region 4*a* of the cable channel pipe 4 as shown in FIG. 1 is positively held.

The shells 15, 16, 17 of the adapter 5 are advantageously made of polyamide (PA) or of polypropylene (PP). The vacuum cleaner suction pipe 3 is advantageously made in the conventional manner as a telescoping pipe and consists of high-grade steel.

When the adapter 5 is damaged, only it needs to be replaced. For this purpose, the clamping screws are screwed out of the openings 22, 25, the adapter 5 is folded away on the parting joint 45 and both the plug 36 which is located in the recess 35 and also the end region 4*a* of the cable channel pipe 4 are removed from the recess 46. Accordingly, the end region 4*a* of the cable channel pipe 4 is inserted into a new adapter 5 and the plug 36 is inserted into the recess 35, the shells 15, 16 and 17 are folded together again, the clamping screws are inserted through the openings 22, 25 and tightened until the end position of the parting joint 45 is reached as shown in FIG. 13. A new vacuum cleaner suction pipe 3 is likewise unnecessary, like a new handle 6.

What is claimed is:

1. Vacuum cleaner comprising:

a handle having a pipe socket, a suction pipe having a nozzle on a free end of thereof, an adapter, a first end of which accommodates and end region of the vacuum cleaner suction pipe and a second end of which is coupled to the pipe socket of the handle via a detachable locking means, a flexible hose, and electrical couplings forming an electrically conductive connection from the nozzle of the suction pipe, via the vacuum cleaner suction pipe, the adapter, the handle, and the flexible vacuum hose to a power supply of the vacuum cleaner, wherein the adapter is formed of at least two shells which are pivotably connected together via a film hinge which runs parallel to a lengthwise axis of the suction pipe, free end regions of the shells being detachably braced against facing end regions of the suction pipe via a screw connection in a mounted position thereof.

2. Vacuum cleaner in accordance with claim 1, wherein the adapter is also provided with an anti-torsion means for preventing relative rotation between the adapter and the suction pipe and pipe socket of the handle.

3. Vacuum cleaner in accordance with claim 2, wherein the anti-torsion means comprises a recess on the end region of the vacuum cleaner suction pipe and a cam on the adapter which engages in the recess.

4. Vacuum cleaner in accordance with claim 1, wherein the adapter comprises three shells which are connected to one another via film hinges which run parallel to the lengthwise axis of the vacuum cleaner suction pipe.

5. Vacuum cleaner in accordance with claim 1, wherein the shells on their insides have a shape in the form of pitch circle segments which circularly surround the end region of the suction pipe and the pipe socket of the handle.

6. Vacuum cleaner in accordance with claim 4, wherein the three shells comprise a middle shell flanked on each side by a respective outer shell, wherein a projecting strip which is L-shaped in cross section is provided on an end of each of the outer shells, wherein the projecting strips, together, form a receiver which is U-shaped in cross section that receives a geometrically similar part of the handle.

7. Vacuum cleaner in accordance with claim 6, wherein a locking means is provided on the pipe socket and wherein a middle region of the middle shell is provided with a button which is molded on in the shape of a leaf spring for pressing down the locking means on the pipe socket.

8. Vacuum cleaner in accordance with claim 1, wherein the shells are provided with stiffening ribs on an inner side thereof.

9. Vacuum cleaner in accordance with claim 1, wherein a through opening for a clamping screw is provided on each end of one of the shells and blind holes for holding the clamping screws is provided at corresponding locations on another of the shells.

10. Vacuum cleaner in accordance with claim 1, wherein the shells have end region facing the handle which is provided with a recess for insertion of an electric plug for the electrically conductive connection along the suction pipe.

11. Vacuum cleaner in accordance with claim 10, wherein the plug is coupled to an electrical socket part located on a facing end of the handle when the adapter is coupled to the pipe socket of the handle.

12. Vacuum cleaner in accordance with claim 1, wherein the shells are made of a plastic from the group consisting of polyamide (PA) and from polypropylene (PP).

13. Vacuum cleaner in accordance with claim 1, wherein the vacuum cleaner suction pipe is a telescoping pipe.

* * * * *